United States Patent [19]

Ostwald

[11] 3,937,276

[45] Feb. 10, 1976

[54] AFTERCOOLER FOR AIR COMPRESSOR

[75] Inventor: Richard Ostwald, Bowling Green, Ky.

[73] Assignee: Gordon Smith & Co., Inc., Bowling Green, Ky.

[22] Filed: May 21, 1974

[21] Appl. No.: 472,024

[52] U.S. Cl. ..... 165/135; 165/74; 165/132; 165/158; 415/179

[51] Int. Cl.[2] ..... F28D 1/06; F28F 1/00

[58] Field of Search ..... 165/132, 158, 74, 73, 135; 415/179

[56] References Cited

UNITED STATES PATENTS

| | | | |
|---|---|---|---|
| 2,046,569 | 7/1936 | Madorin | 165/74 X |
| 2,774,575 | 12/1956 | Walter | 165/158 X |
| 3,133,590 | 5/1964 | Lowe | 165/132 X |
| 3,237,684 | 3/1966 | Morgan | 165/132 X |
| 3,315,732 | 4/1967 | Garwin et al. | 165/135 X |
| 3,398,789 | 8/1968 | Wolowodiuk et al. | 165/158 |
| 3,776,303 | 12/1973 | Anderson et al. | 165/158 X |
| 3,814,178 | 6/1974 | Parussel | 165/158 |
| 3,856,078 | 12/1974 | Dahl | 165/132 X |

FOREIGN PATENTS OR APPLICATIONS

| | | | |
|---|---|---|---|
| 549,599 | 4/1956 | Belgium | 165/158 |

*Primary Examiner*—Albert W. Davis, Jr.
*Assistant Examiner*—Sheldon Richter
*Attorney, Agent, or Firm*—William E. Mouzavires

[57] ABSTRACT

A tubular heat exchanger designed for easy and compact mounting within a receiver tank. Within the rigid casing of the heat exchanger are mounted a plurality of spaced, parallel tubes. Coolant fluid entering one end of the heat exchanger, flows through a group of the tubes, and returns to the same end of the heat exchanger through the remaining tubes, whereupon it exits the exchanger. Hot fluid such as compressed air enters one end of the exchanger, passes along the length of the exchanger while intermingling with the tubes so as to be cooled, and then exits into a receiver tank through a plurality of holes located in the opposite end of the heat exchanger.

10 Claims, 3 Drawing Figures

AFTERCOOLER FOR AIR COMPRESSOR

BACKGROUND OF THE INVENTION

This invention relates to an improved apparatus known as an "aftercooler" for continuous cooling of hot fluids such as compressed air. More particularly, this invention relates to an apparatus for cooling of hot fluids such as compressed air travelling to a receiver tank which apparatus is designed to be mounted within a receiver tank.

The use of heat exchange apparatus for cooling compressed air after it has been compressed and prior to receipt in a receiver tank, is, of course, well known. In one conventional aftercooler, a cooling fluid is passed through a bundle of tubes, known as admiralty tubes, contained within a rigid, tubular enclosure. The hot, compressed gas is submitted through a port in one end of the tubular enclosure, intermingles with the cooling tubes to be cooled, and is released through a second port located at the opposite end of the tubular enclosure. The cooled compressed gas is then directed to a receiver tank for storage until use.

A number of undesirable features have been inherent in such aftercoolers of the prior art. For example, the normal heat exchanger is quite large and at times creates a space problem while also requiring certain ducts and pipe fittings. In addition, such prior apparatus often creates undesirable noise which today is no longer tolerable in view of newly promulgated environmental laws.

OBJECTS

It is therefore an object of the present invention to provide a heat exchange apparatus or aftercooler for cooling compressed gases, which may be quickly and easily mounted directly within a receiver tank.

It is a further object of this invention to provide such an aftercooler which is largely contained within a receiver tank in order to conserve space as well as to reduce noise.

It is a further object of the present invention to provide such an aftercooler with novel exit means for the cooled, compressed gas which will effectively reduce noise.

Another object of the present invention is to provide such an aftercooler that may be easily manufactured from standard materials for application to conventional or new air compressor systems.

SUMMARY OF THE INVENTION

The present invention comprises an aftercooler for the cooling of hot gases which is constructed to be mounted within a receiver tank, thereby saving space outside the tank. A plurality of spaced, parallel admiralty tubes extend between opposite ends of a rigid, tubular casing. Each of the ends of the casing is capped with a cowl, one cowl having an inlet for cooling fluid as well as a baffle to direct cooling fluid in one direction into a first group of the admiralty tubes, and an outlet for the spent cooling fluid. The opposite cowl directs the cooling fluid in opposite direction to the remaining group of the admiralty tubes for exit through the outlet in the first cowl. Hot, compressed gases from an air compressor enter the casing through a port adjacent the first cowl, and exit through a plurality of spaced holes at the opposite end of the casing. The casing is provided with threads for direct insertion within a receiver tank, the threads located such that a majority of the casing extends within the receiver tank. By virtue of the small holes or exit ports through which the cooled gases enter the receiver tank, and the receiver tank structure enclosing the aftercooler, noise heretofor produced with conventional devices is substantially reduced.

Other objects and advantages of the invention will become apparent from the following detailed description, taken in conjunction with the accompanying drawing, in which:

DRAWING

DETAILED DESCRIPTION

Figure 1:
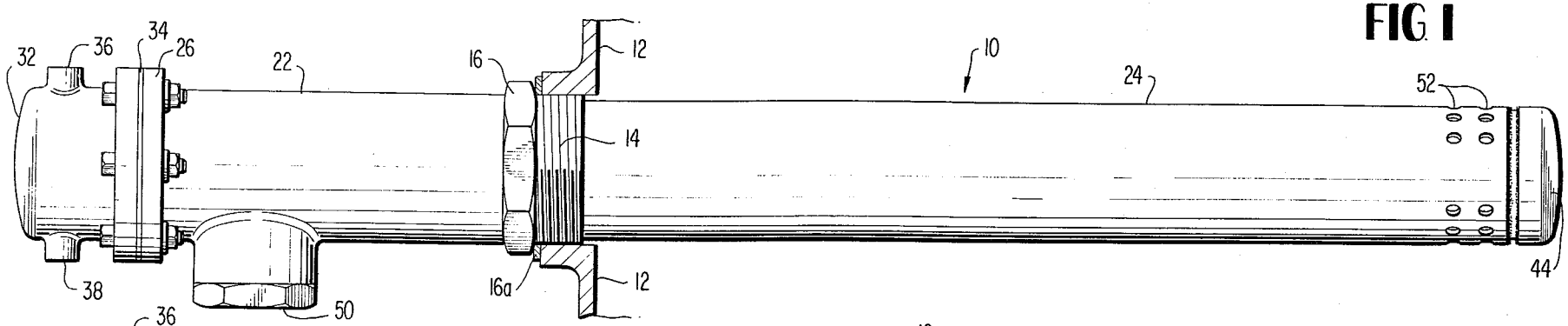
FIG. 1 is a side elevational view of an aftercooler embodying the present invention shown mounted within a receiver tank which is partly shown in cross-section.
Figure 2:
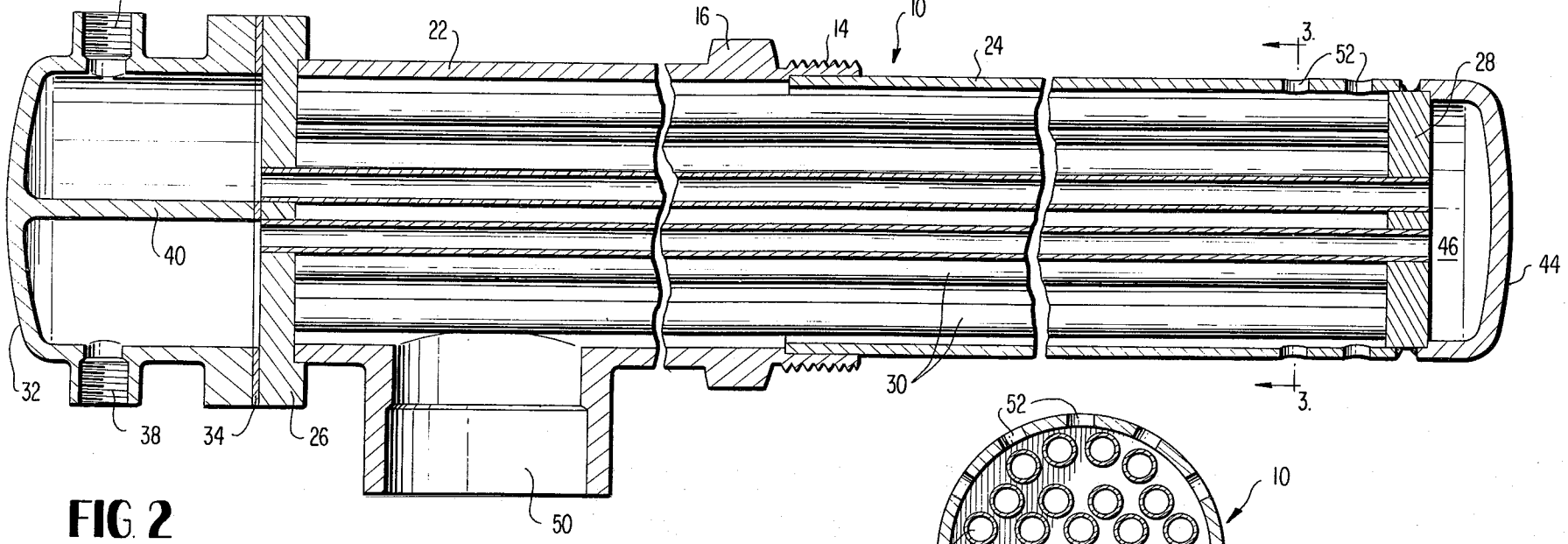
FIG. 2 is an enlarged longitudinal cross-sectional view of the aftercooler of FIG. 1 showing the internal portions thereof, and with intermediate sections removed for brevity.

In FIG. 1, heat exchange apparatus termed an aftercooler 10 embodying the present invention is shown mounted within a receiver tank, the receiver tank shown by wall fragments 12 and being used to store compressed gas such as compressed air. Heat exchange apparatus 10 is threaded intermediate its ends at 14 for rigid insertion and mounting directly into receiver tank 12. Also, a flange 16 is employed to abut receiver tank 12 and provide a hermetic seal which may be augmented by a sealing gasket 16a. Threads 14 and flange 16 can be an integral part of heat exchange apparatus 10, or can be portions of a separate band of metal or other fitting which is welded or otherwise fixed to heat exchange apparatus 10. Additionally flange 16 is provided with lands such as in a hexagonal nut to receive a pipe wrench for example during installation in the receiver tank 12.

Heat exchange apparatus 10 may comprise one or more tubular casing sections 22 and 24, coaxially secured to each other as shown or may be constructed of a single tubular casing section. An apertured plate 26 is located adjacent one end, the inlet end, of heat exchanger 10. Apertured plate 26 may be an integral portion of tubular section 22, or may be welded or otherwise attached thereto as shown. At the opposite or outlet end of heat exchanger 10, a second apertured plate 28 is fixed within casing section 24.

Extending between and fixed to apertured plates 26 and 28 are a plurality of parallel admiralty tubes 30. Each admiralty tube 30 communicates with respective apertures in plates 26 and 28.

At the inlet end of the apparatus, a cowl 32 is attached to apertured plate 26, with a gasket 34 forming a seal between cowl 32 and apertured plate 26. Cowl 32 comprises a cupped member, and includes an entry port 36 and exit port 38 for coolant fluid separated, by an apertured baffle 40. Entry port 36 and exit port 38 can be interchanged without any effect to the apparatus.

At the opposite or outlet end of heat exchanger 10, a cowl or cupped member 44 is fixed to apertured plate 28 in order to seal close cavity 46 formed between apertured plate 28 and cupped member 44.

Figure 3:
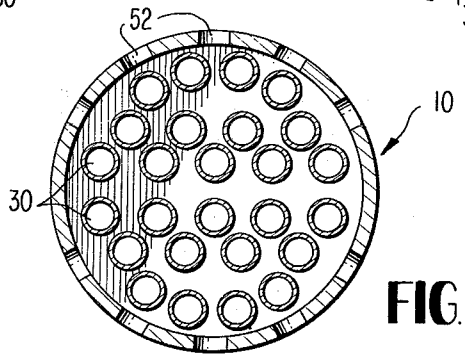
FIG. 3 is a cross-sectional view taken along line 3—3 of FIG. 2.

Heat exchanger 10 also includes an air inlet port 50 adjacent the inlet end thereof, as well as a plurality of angularly spaced holes or outlet ports 52 at the outlet end thereof which communicate with the interior of the receiver tank. Air outlet ports 52 are placed in at least one circular pattern about the periphery of heat exchanger 10. As shown in FIG. 3, ports 52 are placed at 0°, 30°, 60°, 120°, 150°, 180°, 210°, 240°, 300° and 330° about the periphery of the heat exchanger. In the preferred embodiment, two sets of such apertures are provided as shown. By being so placed, ports 52 allow the exit of cooled air in all directions, while also acting to dissipate energy and reduce noise normally attendant such a system.

In operation, any suitable coolant fluid is passed through entry port 36 and enters tubes 30 while being prevented from passage out exit port 38 by baffle 40. The coolant passes through the group of tubes 30 on one side of the baffle 40 along the length of heat exchanger 10, then entering cavity 46; and then returning through the remainder of tubes 30 and exiting from heat exchanger 10 via port 38. Hot compressed gases such as from an air compressor (not shown) enter heat exchanger 10 through port 50 and pass along the entire length of heat exchanger 10, intermingling with admiralty tubes 30 and thereby through heat exchange, becoming cooled. The cooled compressed air leaves heat exchanger 10 through ports 52 and is then stored in receiver tank 12 for use.

What is claimed is:

1. An aftercooler for cooling compressed gas such as compressed air, the aftercooler including a tubular casing having a plurality of internal ducts for conveying coolant fluid therethrough with spaces between the ducts, said casing having a first inlet port for introducing coolant fluid into the casing to pass through certain of said cooling ducts, an outlet port for discharging spent cooling fluid from the casing, said casing having a second inlet port for introducing a compressed gas to be cooled such as compressed air into the casing to pass in the spaces between the cooling ducts, said casing having outlet means adjacent one end thereof for exiting the cooled compressed gas from the casing and into a receiving tank, and said casing having means for fixing a portion of said casing to a wall of a receiving tank with said outlet means for the compressed gas located within a receiving tank, and with said inlet and outlet ports for the cooling fluid located externally of a receiving tank, and wherein said inlet and outlet ports for the coolant fluid are situated adjacent the end of the casing opposite said one end where said outlet means for the compressed gas is located, and wherein the outlet means for exiting the compressed gas includes a first set of a plurality of small apertures angularly spaced around the periphery of the casing for reducing noise associated with the discharge of the compressed gas.

2. The aftercooler defined in claim 1 including an apertured wall member adjacent said one end of the casing having apertures communicating with the cooling ducts, and wherein said casing contains a chamber adjacent said one end thereof for receiving coolant fluid from a first group of tubes and for directing the coolant fluid to a second group of tubes.

3. The aftercooler defined in claim 1 wherein said apertures are spaced 30° from each other around the periphery of the casing.

4. The aftercooler defined in claim 1 wherein the outlet means for exiting the compressed gas includes a second set of a plurality of small apertures angularly spaced around the periphery of the casing closely adjacent the first set of apertures.

5. The aftercooler defined in claim 1 wherein said means for fixing the casing to a wall of a receiving tank includes a plurality of threads extending circumferentially around the casing for receipt in mating threads in a wall of a receiver tank.

6. The aftercooler defined in claim 5 wherein said last defined means further includes a flange radially projecting from the casing adjacent said threads for engagement against a wall of a receiving tank.

7. The aftercooler defined in claim 6 wherein said last defined means further includes a seal extending about the casing against said flange for engagement against the wall of a associated receiving tank.

8. The aftercooler defined in claim 6 further including a pair of wall members respectively situated transversely in said opposite ends of the casing and having apertures respectively receiving said internal ducts for conveying coolant fluid through the ducts, and wherein there is further included a first cowl at said one end of the casing containing a chamber in said one end of the casing for receiving cooling fluid from a first group of ducts and for directing the cooling fluid to a second group of ducts, and wherein there is further included a second cowl at the end of the casing opposite said first end, said second cowl including a baffle dividing the space enclosed by the cowl into two compartments, one compartment communicating with said first inlet port for introducing coolant fluid into the casing and the other compartment communicating with the outlet port for discharging spent cooling fluid from the casing.

9. In combination with a receiving tank for a compressed gas such as a receiving tank in an air compressor system for receiving compressed air to be subsequently discharged at a point of use and wherein the receiving tank includes a chamber for receiving the compressed gas; an aftercooler for cooling the compressed gas prior to receipt in the receiving tank, the aftercooler including an elongated body having heat exchange means therein, said body being mounted to the receiving tank with a first portion of said body being received in said chamber and with a second portion of said body being located externally of the receiving tank, said body having an inlet port located in said second portion thereof for directing the compressed gas into said body to be cooled, and said body having in said second portion thereof an outlet means for discharging the compressed gas after cooling into said chamber, and wherein said outlet means includes a plurality of small angularly spaced apertures communicating with said chamber for exiting the cooled compressed gas directly into said chamber of the receiving tank.

10. The combination defined in claim 9 wherein said body has a plurality of external screw threads and wherein said receiving tank has a wall enclosing said chamber, said wall having an aperture receiving said body, and said wall having screw threads surrounding said aperture and receiving said threads of said body to secure the body in the receiving tank.

* * * * *